United States Patent [19]

Schwindt et al.

[11] 4,428,642

[45] Jan. 31, 1984

[54] BODY-CARRY ELECTRICAL CONTACT STRIPS

[75] Inventors: Gary W. Schwindt, Washington, Conn.; Walter W. Wurster, West Covina, Calif.

[73] Assignee: Litton Systems, Inc., Watertown, Conn.

[21] Appl. No.: 338,368

[22] Filed: Jan. 11, 1982

[51] Int. Cl.[3] ..... H01R 4/14

[52] U.S. Cl. ..... 339/276 SF; 339/220 R

[58] Field of Search ..... 339/220 R, 221 R, 221 M, 339/276 SF

[56] References Cited

U.S. PATENT DOCUMENTS

| | | | |
|---|---|---|---|
| 3,328,749 | 6/1967 | Kukla | 339/221 R |
| 3,902,776 | 9/1975 | Williams et al. | 339/276 SF |
| 4,206,964 | 6/1980 | Olsson | 339/221 M |
| 4,261,629 | 4/1981 | Reynolds et al. | 339/276 SF |
| 4,265,508 | 5/1981 | Chisholm | 339/276 SF |

*Primary Examiner*—Joseph H. McGlynn
*Assistant Examiner*—Gary F. Paumen
*Attorney, Agent, or Firm*—Brian L. Ribando

[57] ABSTRACT

A strip of body-carry electrical contacts formed by a progressive die from flat strip stock comprises a series of identical electrical contacts integrally joined by central contact carrier segments. The contact carrier segments are displaced relative to the plane of the contact strip such that the interface between each carrier segment and each electrical contact is partially severed. Accordingly, the contact strip will withstand normal manufacturing processes and the carrier segments may be removed from the contact strip to separate the contacts without a metal cutting operation.

1 Claim, 2 Drawing Figures

Fig_1
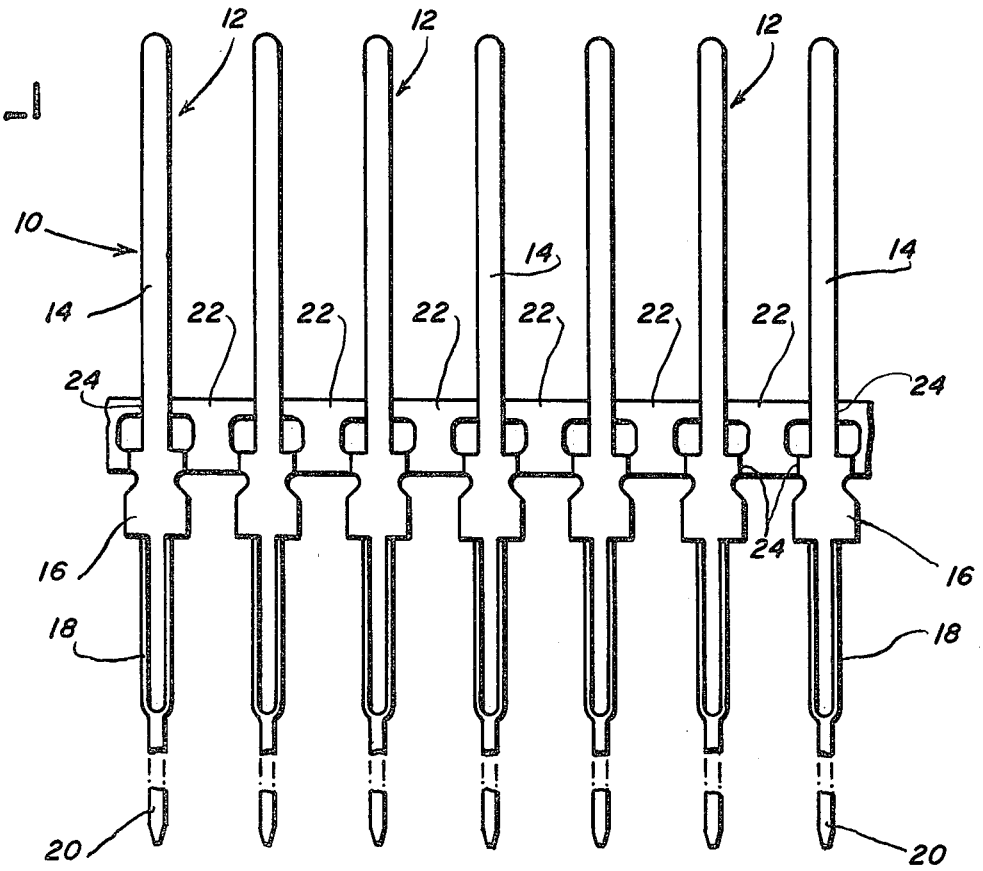
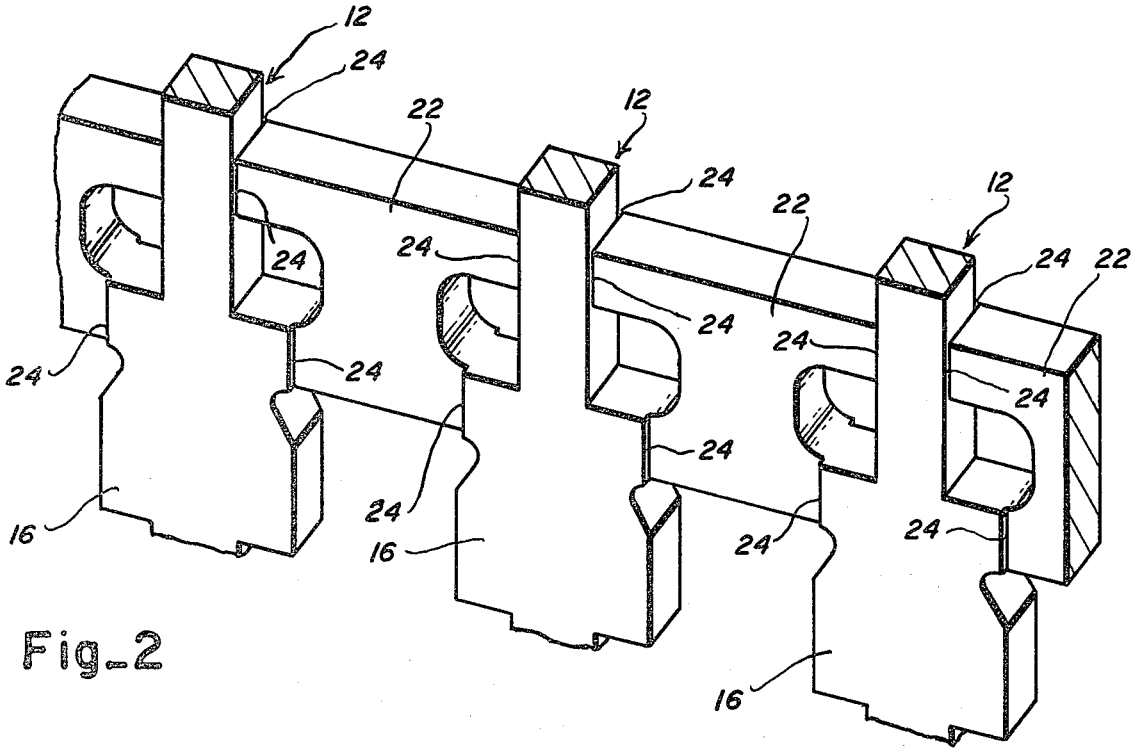
Fig_2

BODY-CARRY ELECTRICAL CONTACT STRIPS

This invention relates to electrical contacts, and in particular, to combs or integral strips of electrical contacts which may be easily separated into individual contacts without the requirement of a cutting operation.

Printed circuit board contacts may be formed from flat strip stock using conventional progressive die techniques. In order to facilitate the contact mounting operation into the plated through hole arrays of a printed circuit board, the contacts, when formed, remain integrally connected in a strip or comb wherein the contacts have a spacing selected to match the spacing of the circuit board holes. The integral stock portion which links contacts to one another may comprise top or bottom carrier strips attached to the respective ends of each contact, or a carrier segment joining the adjacent contacts at their central, or body regions. Contact strips employing the former construction are called end-carry contacts, while contacts strips employing the latter construction are called body-carry contacts.

At some point in the assembly process, the carrier strips or segments must be removed from the combs of contacts. One method of installing contacts joined by body-adjacent segments is to clamp a comb of 50–100 contacts in a fixture, cut away all the carrier segments simultaneously from between the contacts, and then insert the contacts into the printed circuit board. This method is problematic, since the cutting operation must be very precise to properly sever the carrier segments from the contacts. The precise cutting requires that the contact combs be rigidly held in a precision fixture and struck with a sharp cutting die. The equipment required for such operations is expensive, is prone to malfunction, and requires frequent maintenance.

It is therefore an object of the present invention to provide body-carry contacts which are partially severed during fabrication so as to be separable into discrete contacts without a subsequent cutting operation.

It is another object of the invention to provide improved strips of body-carry contacts which may be easily separated into individual contacts to facilitate their installation into a printed circuit board.

Other objects and advantages of the present invention will become apparent from the following portion of the specification and from the accompanying drawings which illustrate, in accordance with the mandate of the patent statutes, a presently preferred embodiment incorporating the principles of the invention.

FIG. 1 shows a strip of body-carry electrical contacts made in accordance with the teachings of the present invention; and FIG. 2 is a perspective view of a portion of the strip of body-carry contacts shown in FIG. 1.

A contact strip 10 comprises a series of identical contacts 12 which are formed from strip stock in a progressive die. The contacts 12 are spaced from one another by a distance which is equal to the spacing of plated through holes in a printed circuit board (not shown) into which the contacts are to be mounted. Each contact 12 includes an upper tail portion 14, a central contact shoulder 16, a body portion comprising a central circuit board mating section 18, and a free-standing lower portion 20. The central circuit board mating section 18 of each contact is designed to be mounted into the plated through hole arrays of a printed circuit board. The upper tail portion 14 and the freestanding lower portion 20 provide contact terminals to which lead wires may be coupled by a conventional wire-wrapping process or provide the mating surfaces for a connector.

As best seen in FIG. 2, the contacts 12 are joined to one another by integrally formed carrier segments 22 which link the bodies of adjacent contacts. The progressive die which forms the contact strip 10 displaces the carrier segments 22 out of the plane of the contact shoulder 16. This displacement causes a partial fracture at the interface 24 between each contact 12 and carrier segment 22. The displaced carrier segments 22 and contacts 12 form a contact strip which will withstand normal manufacturing processes such as plating, reeling, etc., but will allow easy separation of the contacts without subsequent metal cutting. Accordingly, when it is desired to separate the contacts of the strip 10 into a series of discrete contacts, a toothed knock out tool (not shown) may be used to knock out the carrier segments 22 from the strip 10 leaving the contacts 12 unattached to one another. This knock out operation is not as precise nor as forceful as in a conventional metal cutting operation, since the contacts and carrier segments are already partially severed.

The displacement of the carrier segment which prefractures the metal at the precise point where later separation is to occur is not the same as a carrier segment which is attached to a contact by an area of metal which has been coined. Coining reduces the thickness of the metal by localized flattening of the metal, but also results in a spreading or growing of the metal in the area where the coining has taken place. This metal growth may be unacceptable in the manufacturing process, and does not result in a clean separation between the contact and the carrier when the contacts are subsequently removed from the carrier portion.

Accordingly, the invention is not to be limited to partially severed carrier segments which are adjacent the body portion of the contact, but is meant to includes partially severed carrier segments which are adjacent any portion of the contact.

What is claimed is:

1. A strip of body-carry electrical contacts formed by a progressive die from flat strip stock, the strip comprising, a series of identical electrical contacts, aligned in an evenly spaced row, each contact including a free-standing upper portion, a body portion comprising a central circuit board mating section, and a free-standing lower portion, a plurality of contact carrier segments located one each between adjacent contacts proximate said body portions for maintaining said contacts integrally joined in said evenly spaced row, and said contact carrier segments being displaced relative to the plane of the contact strip such that the displacement causes the interface between each carrier segment and each electrical contact to be paritally severed, whereby said contact strip will withstand normal manufacturing processes and wherein said displaced carrier segments may be removed from said contact strip without a metal cutting operation.

* * * * *